US005650790A

United States Patent [19]

Fukuchi et al.

[11] Patent Number: 5,650,790

[45] Date of Patent: Jul. 22, 1997

[54] ANTENNA DEVICE FOR RADIO TRANSMISSION-RECEPTION APPARATUS

[75] Inventors: Masahisa Fukuchi; Hideo Hikuma; Hiroki Ohno; Makoto Ehara, all of Chiba-ken, Japan

[73] Assignee: Uniden Corporation, Chiba-ken, Japan

[21] Appl. No.: 566,564

[22] Filed: Nov. 28, 1995

[30] Foreign Application Priority Data

Aug. 16, 1995 [JP] Japan ..... 7-208882

[51] Int. Cl.[6] ..... H01Q 1/24

[52] U.S. Cl. ..... 343/702; 343/906

[58] Field of Search ..... 343/900, 895, 343/702, 905, 906; H01Q 1/24

[56] References Cited

U.S. PATENT DOCUMENTS

| | | | |
|---|---|---|---|
| 4,868,576 | 9/1989 | Johnson | 343/702 |
| 5,262,792 | 11/1993 | Egashira | 343/895 |
| 5,479,178 | 12/1995 | Ha | 343/900 |

*Primary Examiner*—Michael C. Wimer
*Attorney, Agent, or Firm*—Fish & Richardson P.C.

[57] ABSTRACT

An antenna device for a radio transmission-reception apparatus is disclosed which comprises an antenna element which is to be electrically and mechanically connected to a printed-circuit board fixed in a housing of the radio transmission-reception apparatus, an inverted U-shaped hollow reinforcement spacer, an antenna cover and a retaining portion formed on the housing. The reinforcement spacer has a hole formed in the top portion thereof a diameter of which is substantially equal to that of the antenna element to slide therethrough, a slit formed continuously from the hole to a base end thereof through which said antenna element can be entered in the reinforcement spacer, and a flange formed around the outer circumference of the base end. The antenna cover is constituted to accommodate therein the antenna element with the reinforcement spacer, and has a flange formed around the circumference of a base end thereof. The flanges of the antenna cover and the reinforcement spacer are fixedly supported in the retaining portion provided on the housing in a state that said flanges are stacked upon each other. Since the most of forces caused by vibration and/or impact supplied to the antenna element are absorbed by the reinforcement spacer, a mechanically and electrically connected portion between the antenna element and the printed-circuit board will be effected by the forces and thus damage to the portion will be eliminated.

3 Claims, 2 Drawing Sheets

ANTENNA DEVICE FOR RADIO TRANSMISSION-RECEPTION APPARATUS

BACKGROUND OF THE INVENTION

1. Field of the Invention

The present invention relates to an antenna device which is mounted on a radio transmission-reception apparatus such as a base unit and a handset unit of a cordless telephone.

2. Prior Art

In a conventional antenna device for a radio transmission-reception apparatus, a base portion of an antenna element is bent, the leading end or tip portion of the base portion so bent is inserted into a hole formed through a printed-circuit board in the transmission-reception apparatus, and the leading end of the base portion is soldered to a back surface of the printed-circuit board to electrically and mechanically connected to the printed-circuit board.

With the above-mentioned conventional antenna device, however, there is a disadvantage that when vibration and/or impact are applied to the antenna, stress caused by the vibration of the antenna is then applied to the solder-fixed portion of the printed-circuit board to thereby damage the portion, with the result that damage to the electrical and/or mechanical connections between the antenna and the printed-circuit board may occur.

In order to protect the solder-fixed portion against such damage, there has been proposed an antenna device in which a lower portion of an antenna element is wound in a coil so that some of the vibration of the antenna is absorbed by the coiled portion. Even in such a conventional example as this type, however, the solder-fixed portion is still subject to the stress, and thus there is a risk of the solder-fixed portion being damaged by such stress. Furthermore, there is a problem that electrical characteristics of the antenna are affected when the coiled portion is deformed by the stress.

An object of the present invention is to provide an antenna device which can solve the above-mentioned problems inherent in the conventional examples, whereby even when vibrations and/or impacts are applied to an antenna element, the antenna element is prevented from being deformed and electrical and mechanical connection between the antenna element and a printed-circuit board is prevented from being broken.

Another object of the present invention is to provide an antenna device capable of being mounted on a radio transmission-reception apparatus by means of a simple assembling operation, thereby reducing production cost thereof.

SUMMARY OF THE INVENTION

In achieving the above-mentioned objects, the present invention is directed to the provision of an antenna device for a radio transmission-reception apparatus which comprises:

an antenna element which is to be electrically and mechanically connected to a printed-circuit board fixed in a housing of said radio transmission-reception apparatus;

an inverted U-shaped hollow reinforcement spacer having a hole formed in the top portion thereof a diameter of which is substantially equal to that of said antenna element to slide therethrough, a slit formed continuously from said hole to a base end thereof through which said antenna element is entered in said reinforcement spacer, and a flange formed around the outer circumference of the base end;

an antenna cover for accommodating therein said antenna element with said reinforcement spacer, said antenna cover having a flange formed around the circumference of a base end thereof; and a retaining means provided on said housing of said radio transmission-reception for supporting said flanges of said reinforcement spacer and said antenna cover therein in a state that said flanges are stacked upon each other.

With such a constitution of the present invention as described above, after an antenna device is assembled on the housing or cabinet of the radio transmission-reception apparatus, stress to a solder-fixed portion, which is generated by vibration, impact and the like applied to the antenna, is absorbed by the reinforcement spacer, and therefore the electrically and mechanically connected portion or solder-fixed portion is free from any damage. In addition thereto, the antenna device can be mounted on the housing from the outside thereof by means of simple processes, and therefore this provides an assembling operation and low cost of products.

DETAILED DESCRIPTION THE PREFERRED EMBODIMENTS

Figure 1:
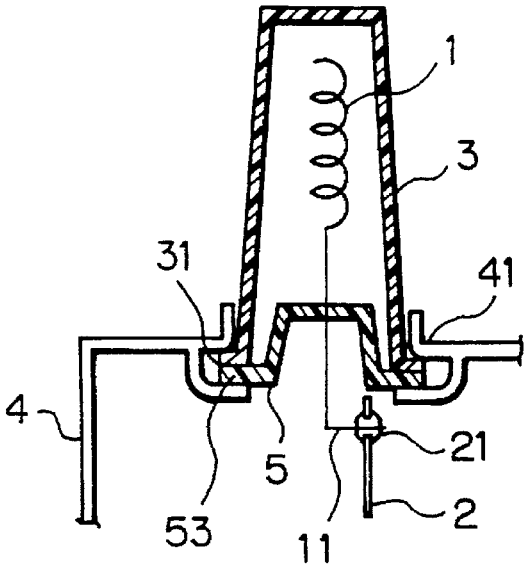
FIG. 1 is a schematic sectional view showing a configuration of an embodied antenna device according to the present invention.

FIG. 1 is a schematic sectional view of an antenna device according to one embodiment of the present invention, and in the drawing, reference numeral 1 denotes an antenna element, and reference numeral 2 denotes a printed-circuit board. The antenna element 1 is covered with an antenna cover 3, and the printed-circuit board 2 is fixedly disposed by a suitable fixing means (not shown) in a housing 4 of a radio transmission-reception apparatus such as a handset unit or a base unit of a cordless telephone or the like. Reference numeral 5 denotes a reinforcement spacer for reinforcing the antenna element 1. The present invention is characterized by the provision of this reinforcement spacer 5.

An upper portion of the antenna element 1 is formed into a coil, while a lower portion thereof is bent at substantial right angle so as to form a mounting portion 11 by which the antenna element 1 is mounted to the printed-circuit board 2. The antenna cover 3 is molded from an elastic material such as elastomer, and has a flange 31 formed around the outer circumference of a proximal or base end portion thereof. The flange 31 is fitted into a supporting or retaining portion 41 provided on the housing 4.

A through hole is formed through the printed-circuit board 2 so that the mounting portion 11 of the antenna element 1 is inserted therethrough. After it has been put through the through hole, the mounting portion 11 is soldered to the printed-circuit board, whereby the antenna element 1 is mechanically fixed to the printed-circuit board 2 at the solder-fixed portion 21 and is electrically connected therewith. It is possible to bend again the mounting portion 11 of the antenna element 1 after the insertion of the portion 11 through the hole and to insert it in another through hole of the printed-circuit board 2 to be strongly secured thereto.

Figure 2A:
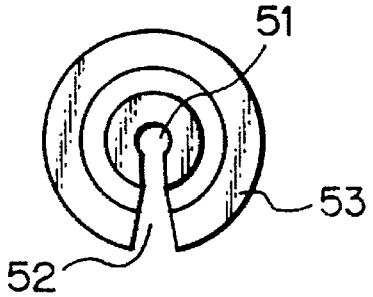
FIGS. 2(A) and 2(B) show top and side views of a reinforcement spacer of the antenna device shown in FIG. 1.
Figure 2B:
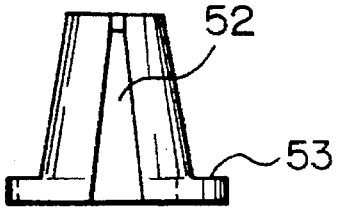

The reinforcement spacer 5 is constituted by an elastic material such as ABS resin or silicone rubber and has hollow a sectional view of which is an inverted U-shape as shown in FIG. 1. Further, as shown in top and plan views of FIGS. 2(A) and 2(B), a through hole 51 having a diameter substantially coinciding with that of the antenna element 1 is formed in a top part of the reinforcement spacer 5, and a slit 52 extending from the hole 51 of the top part to a base end of the spacer 5 is formed in a side thereof. Therefore, the antenna element 1 can enter into the reinforcement spacer 5 from the side thereof by means of the slit 52, and it contacts only with a circumferential edge of the hole 51 of the reinforcement spacer 5 under a state that it has completely combined with the reinforcement spacer 5. In addition to the hole 51 and slit 52, the spacer 5 has a flange 53 formed on the outer circumferential edge of the base portion. The flange 53 and the flange 31 of the antenna cover 3 are superposed upon each other so as to be fixed together in the retaining portion 41 of the housing 4.

A procedure of mounting the antenna element 1 to the housing 4 will now be described.

First, the lower portion (having no coil) of the antenna element 1 is entered in the reinforcement spacer 5 through the slit 52 to reach the hole 51. Then, the flange 53 of the spacer 5 is caused to be retained in the retaining portion 41 of the housing 4. Next, the antenna element 1 is subjected to slide in the hole 51 of the spacer 5 to be adjusted so that the mounting portion 11 of the antenna element 1 confronts the through hole of the printed-circuit board 2. The mounting portion 11 is then put through the through hole of the printed-circuit board 2 and is soldered. Thereafter, the antenna cover 3 is placed over the antenna element 1, and the flange 31 of the antenna cover 3 is superimposed upon the flange 53 of the reinforcement spacer 5 to be supported in the retaining portion 41 of the housing 4, together with the flange 53. Thus, the mounting of the antenna device is completed, and the spacer 5 can absorb vibration of the antenna element 1, thereby preventing the vibration from effecting the soldered portion 21 of the printed-circuit board 2.

It is to be noted that the reinforcement spacer 5 may be provided on the antenna element 1 after the element 1 is soldered to the printed-circuit board 2, and other variations of the mounting procedures of the antenna device may be selected.

In addition thereto, if a circular recessed portion conforming to the shape of the flange 53 of the reinforcement spacer 5 is formed in a lower surface, or a surface which is to be directing to the flange 53, of the flange 31 of the antenna cover 3 and the flange 53 is accommodated the circular recessed portion, the spacer 5 is restricted with respect to a lateral movement (when viewed in FIG. 1), whereby the vibration of the antenna element 1 can further effectively be absorbed. Moreover, the flanges 31 and 53 are not necessarily formed around the whole circumferences of the base ends of the antenna cover 3 and the reinforcement spacer 5, respectively, but may be provided only at several locations of the respective circumferences.

Figure 3:
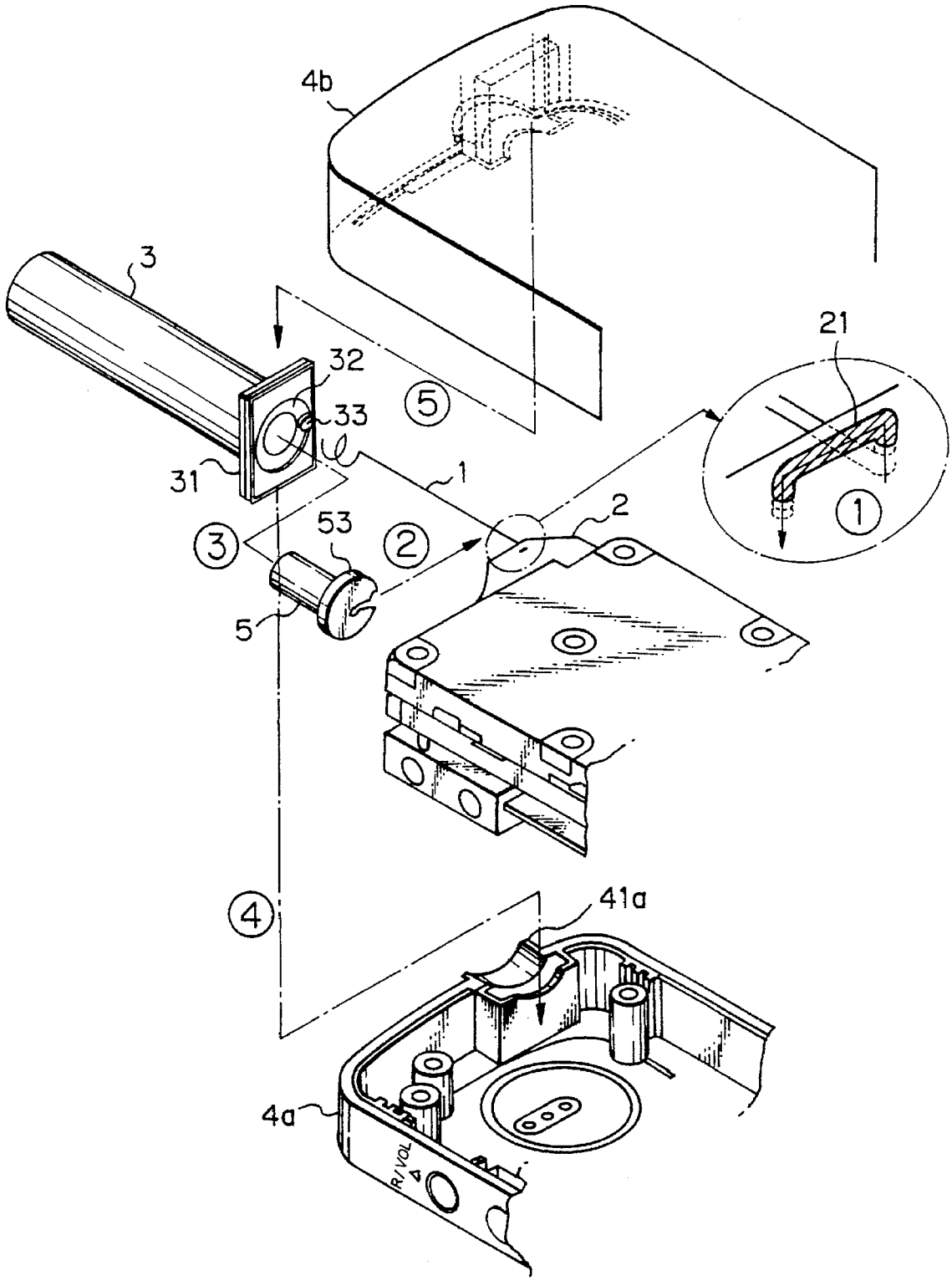
FIG. 3 is an exploded view showing an example in which components of an antenna device according to the present invention are installed in a handset unit of a cordless telephone.

FIG. 3 illustrates an example of processes by which an antenna device according to the present invention is installed in a handset unit of a cordless telephone. In this example, the antenna device is mounted on a housing of the handset unit in the following steps:

① The mounting portion 11 of the antenna element 1 is inserted into the through hole of the printed-circuit board 2 and then soldered;

② The reinforcement spacer 5 is mounted on the antenna element 1 by means of the slit 52;

③ The antenna cover 3 is put on the antenna element 1 on which the reinforcement spacer 5 has already been mounted. At this moment, the flange 53 of the spacer 5 is fitted into a circular recessed portion 32 formed on the inner surface of the flange 31 and a projection 33 formed in the recessed portion 32 is positioned in the base end of the slit 52 of the reinforcement spacer 5;

④ A sealed body incorporating the printed-circuit board 2 is accommodated in a lower housing **4*a* of the handset unit, and the flange 31 of the antenna cover 3 is inserted into a groove formed at a retaining portion 41*a* of the lower housing 4*a*; and ⑤ An upper cabinet 4*b* of the handset unit is placed over the lower housing 4*a***.

In the antenna device according to the present invention, even if force such as vibration and impact is applied to the antenna element 1 from the outside via the antenna cover 3, since the antenna element 1 is in contact with the circumferential edge of the through hole 51 formed in the top portion of the reinforcement spacer 5, the force is distributed from the circumferential edge to the reinforcement spacer 5. Therefore, the force acting on the mounting portion 11 of the antenna element 1 and hence the solder-fixed portion 21 of the printed-circuit board 2 is extremely reduced, thereby making it possible to prevent the solder fixed portion from a damage.

Further, as is described above, since the antenna device according to the present invention can be mounted on a radio-frequency transmission-reception apparatus after the apparatus is substantially completely fabricated, the assembling processes are made extremely simple and thus production costs can be reduced.

While preferred embodiments of the present invention has been described, variations thereto will occur to those skilled in the art within the scope of the present inventive concepts which are declined by the following claims.

What is claimed is:

1. An antenna device for a radio transmission-reception apparatus comprising:

an antenna element which is to be electrically and mechanically connected directly to a printed-circuit board fixed in a housing of said radio transmission-reception apparatus;

an inverted U-shaped hollow reinforcement spacer having a hole formed in a top portion thereof, wherein a diameter of the hole is substantially equal to that of said antenna element to permit said antenna element to slide therethrough, a slit formed continuously from said hole to a base end thereof through which said antenna element is entered in said reinforcement spacer, and a flange formed around an outer circumference of the base end;

an antenna cover for accommodating therein said antenna element with said reinforcement spacer, said antenna cover having a flange formed around the circumference of a base end thereof; and a retaining means provided on said housing of said radio transmission-reception apparatus for supporting said flanges of said reinforcement spacer and said antenna cover therein in a state that said flanges are stacked upon each other.

2. The antenna device according to claim 1, wherein said flange of said antenna cover has a circumferential recessed portion on a rear surface thereof, for accommodating said flange of said reinforcement spacer.

3. The antenna device according to claim 2, wherein said flange of said antenna cover further includes a projection in said recessed portion which is fitted into the end of said slit of said reinforcement spacer.

* * * * *